United States Patent [19]

Sergeant

[11] Patent Number: 4,803,938

[45] Date of Patent: Feb. 14, 1989

[54] ROTOR POWERED SAILBOAT

[76] Inventor: Ron Sergeant, 15931 E. Wind Cir., Sunrise, Fla. 33326

[21] Appl. No.: 135,680

[22] Filed: Dec. 21, 1987

[51] Int. Cl.[4] ..... B63H 9/06

[52] U.S. Cl. ..... 114/39.1; 114/90; 114/102

[58] Field of Search ..... 114/39.1, 89–109, 114/111–115

[56] References Cited

U.S. PATENT DOCUMENTS

| | | | |
|---|---|---|---|
| 2,152,984 | 4/1939 | Wilford | 114/39.1 |
| 2,408,412 | 10/1946 | Dobbins | 114/39.1 |
| 3,859,943 | 1/1975 | Katainen | 114/39.1 |
| 4,276,033 | 6/1981 | Krovina | 114/103 |
| 4,353,702 | 10/1982 | Nagy | 114/102 |
| 4,610,212 | 9/1986 | Petrovich | 114/61 |

FOREIGN PATENT DOCUMENTS

| | | | |
|---|---|---|---|
| 2524569 | 10/1983 | France | 114/103 |
| 126791 | 8/1982 | Japan | 114/39.1 |

*Primary Examiner*—Sherman D. Basinger

*Assistant Examiner*—Stephen P. Avila

*Attorney, Agent, or Firm*—Robert J. Van Der Wall

[57] ABSTRACT

A boat that is powered by an autogyro rotor is disclosed. A boat hull having a stern mounted rudder is provided with a selectively rotatable boom, preferably mounted in proximity to the rudder at the hull centerline. The boom is angled upwardly from its rotatable base, terminating at its upper extremity in a pivoting rotor mount and stops. The stops define the limits of pivot or cant of the rotor axis,the first being preferably horizontal and the second approximately thirty degrees (30°) thereto. When disposed at thirty degrees (+°) the axis passes through the center of lateral resistance of the rudder and hull combination, the effect being to minimize heel, ballast used to resist heel, and that part of a keel used to resist heel, resulting in less drag and greater speed. An upward thrust component of the autogyro rotor also results in reversal of the normally downward force component from heel, further reducing drag and increasing speed. Lee or weather helm is also substantially eliminated.

36 Claims, 4 Drawing Sheets

ROTOR POWERED SAILBOAT

FIELD OF THE INVENTION

The present invention relates to the field of sailboats, and more particularly teaches the use of an autogyro rotor as a substitute for a sail.

BACKGROUND OF THE INVENTION

Since ancient times, it has been well established that the wind can be used to power a boat across the surface of water. Originally, sailboats were probably limited to sailing substantially downwind. The use of a rudder controlled boat direction, particularly when that was different from wind direction, and the development of a keel enabled sailboats to resist sideward movement, or leeway, when the wind varied significantly from being directly behind the boat's intended course. Eventually, it was learned that the use of fore and aft rigged sails that were cut to create a convex surface could be used to create a lift that would actually permit a sailboat to begin to sail to windward. The sail thus became a type of vertical wing. Modern sailboats can usually point to about forty-five degrees to the wind direction, with some boats being capable of doing even better than that. Of course, no conventional sailboat can sail directly toward the wind.

More recent hisory has seen the development of means other than wind to propel boats, such as steam and internal combustion engines. Far greater power could be developed, resulting in much greater speed. Similarly, the science of hydrodynamics was refined to the point that boat hull design became mathematically analytical rather than exclusively empirical, and this in turn resulted in advanced hull designs that reduced both frictional and appendage drag. The efforts to reduce both types of drag, and therefore increase boat hull speed, have been applied to sailboats as well as power boats.

One obvious way to reduce both appendage drag (representing the amount of water that the hull pushes out of the way as it moves through the water) and friction drag (which is a function of wetted surface area of the hull) is to raise the boat out of the water. A so-called displacement type hull has its weight supported by a force equal to the weight of the water displaced by the hull. However, if some of the weight of the hull can be borne by other means, the hull will rise out of the water somewhat, reducing both the amount of water displaced (which must be moved out of the way) and also the wetted surface area. Some prior art in regard to sailboats is directed to this objective.

For example, U.S. Pat. No. 4,610,212 issued to Petrovich teaches the use of a rather sophisticated mechanism that includes a hang glider type sail on a catamaran style hull. The same principle underlies the Physail by Eric Olsen, as described in the January, 1985 issue of "Sail" magazine at page 91. Both utilize lift from the sail to help support boat weight and thus reduce drag To a degree, the same principle is recognized as applying to sailboards, as described in on article on an experimental boat termed a flying proa by Chris White on page 88 of the same issue of "Sail" magazine.

A hypothetical idealized version of this concept is also shown in *Aero-Hydrodynamics of Sailing* by C. A. Marchaj, Copyright 1979 and published by Dodd, Mead & Co. On pp. 125–27, a sailing skimmer is described in which an aerofoil is supposed to lift the hull completely out of the water except for a dagger board keel and rudder.

The concept of reducing drag in a sailboat by using vertical lift is one of several important objectives of the present invention, but the structure used to accomplish same is vastly different than these prior art references. In reality, these references only emphasize the importance of the accomplishment. The means employed by the present invention, an autogyro rotor, has never been employed in the manner here taught, so far as is known.

Actually, there is one known instance wherein an autogyro rotor has been employed in conjunction with a boat hull but with a different structure and for a different purpose. This is described in the August, 1984 issue of "Popular Rotorcraft Flying" magazine at pp. 9–13. However, the boat hull is really nothing more than a pontoon for a gyrocopter whose propulsion is by a towline from a power boat. The autogyro rotor is used for lift, but the structure described is an airborne vehicle, not capable of being propelled while waterborne by the wind for reasons which will become apparent as the present invention's features and essential structure are described. These features include the ability to activate and neutralize the autogyro rotor with respect to the wind, the ability to control rotor orientation to hull centerline responsive to differing wind direction and hull course, and the simultaneous retention of rotor resultant force from the wind through the center of lateral resistance of the hull and rudder combination for all rotor support orientations. The benefit of the latter is to eliminate conventional sailboat heel and yawing due to either a weather or a lee helm. Also eliminated and, in fact, reversed, is the downward force of a conventional sail when the sailboat is heeling.

SUMMARY OF THE INVENTION

Bearing in mind the foregoing, it is a principal object of the present invention to provide a substitute for a conventional sail using an autogyro rotor as the means to harness the wind for a sailboat.

Another object of the invention is to eliminate the heel of a sailboat by locating the axis of rotation of the rotor, and thus its thrust vector, such that the same passes through the center of lateral resistance of the rudder and hull taken together.

A related object of the invention is to minimize the ballast of a sailboat normally needed to resist heel.

A consequent object of the invention is to increase the speed of a sailboat by minimizing ballast, which, in turn, reduces drag.

One more object of the invention is to minimize the need for a keel on a sailboat, since a keel is used, in part, to resist heel that has been eliminated. The result is a further increase in speed since drag is further reduced.

A collateral object of the invention is the elimination of weather helm or lee helm, one of which is usually present in a conventional sailboat, and which causes sailboat inefficiency and thus speed losses. The objective is achieved since the rotor thrust vector passes through the center of lateral resistance.

A primary object of the invention is to eliminate the wasteful downward force component of a conventional sail when a sailboat is heeling because this downward force drives the hull deeper into the water and thus increases drag.

A consequent object of the invention is to increase the speed of a sailboat by eliminating the downward force component of a conventional sail, since doing so reduces drag.

Another primary object of the invention is to reduce the drag of a sailboat equipped with an autogyro rotor by canting said rotor in a manner to create an upward thrust vector on the hull, thus raising the hull in the water.

A resulting object of the invention is to increase the speed of a sailboat equipped with a properly canted autogyro rotor, since the consequent upward thrust reduces drag.

A further object of the invention is to support the autogyro rotor of the present invention on a rotatable boom whose position can be selectively fixed with respect to hull centerline to maximize power derived from wind direction variance from hull centerline to maximize power derived from wind direction variance from hull direction.

Another object of the invention is to provide a pivoting axis for the autogyro rotor so that it can be selectively removed from operation at will by disposing the plane of rotation of the rotor horizontally or parallel to the water surface.

An additional object of the invention is to provide an optional means for pre-rotating the rotor in order to accelerate same to a speed sufficient for autorotation with the wind.

A related object of the invention is to structure the foregoing pre-rotation means for continuous duty to maintain rotation of the rotor in light winds that are insufficient for autorotation.

A further object of the invention is to provide braking means to quickly stop the rotor, said means alternatively comprising a mechanical brake and/or a shunt of leads on a pre-rotator motor.

Other objects and advantages will become apparent to those skilled in the art upon review of the drawings and following descriptions.

In accordance with the primary aspect of the invention, a boat hull having a stern mounted rudder is provided with a selectively rotatable boom, preferably mounted in proximity to the rudder at the hull centerline. The boom is angled upwardly from its rotatable base, terminating at its upper extremity in a pivoting rotor mount and stops. The stops define the limits of pivot or cant of the rotor axis, the first being preferably horizontal and the second approximately thirty degrees (30°) thereto. When disposed at thirty degrees (30°) the axis passes through the center of lateral resistance of the rudder and hull combination.

The autogyro rotor is mounted on a stubshaft concentric with said axis, which stubshaft cants as the principal movable portion of the pivoting rotor mount. Connected to the pivoting rotor mount are a lanyard that cants the rotor, and resilient biasing means that opposes the lanyard and returns the rotor to a horizontal position when tension on the lanyard is relaxed.

Also optionally mounted near the top of the boom is a pre-rotator agent, which is normally used temporarily to initiate rotor rotation. It can also be designed for continuous duty, as is appropriate in light winds, and could then be described simply as a rotator agent. This agent is preferably an electric motor and battery power source, connected to the rotor by suitable apparatus such as pulleys and a belt.

The selectively rotatable boom is provided with rotational restraint to fix the rotational position in a location to optimize the rotor orientation with respect to wind direction. This restraint can be a detent array that cooperates with a dog, a line termed a boom sheet in the nature of a jib sheet, a friction brake or the like.

The invention will be better understood upon reference to the following detailed description read in combination with the drawings in which:

DETAILED DESCRIPTION

Before proceeding with a description of the present invention, it is important to understand a few principles regarding the forces and moments present in the operation of a conventional sailboat. This is in order to fully understand the advantages obtained by means of the present invention.

Figure 1:
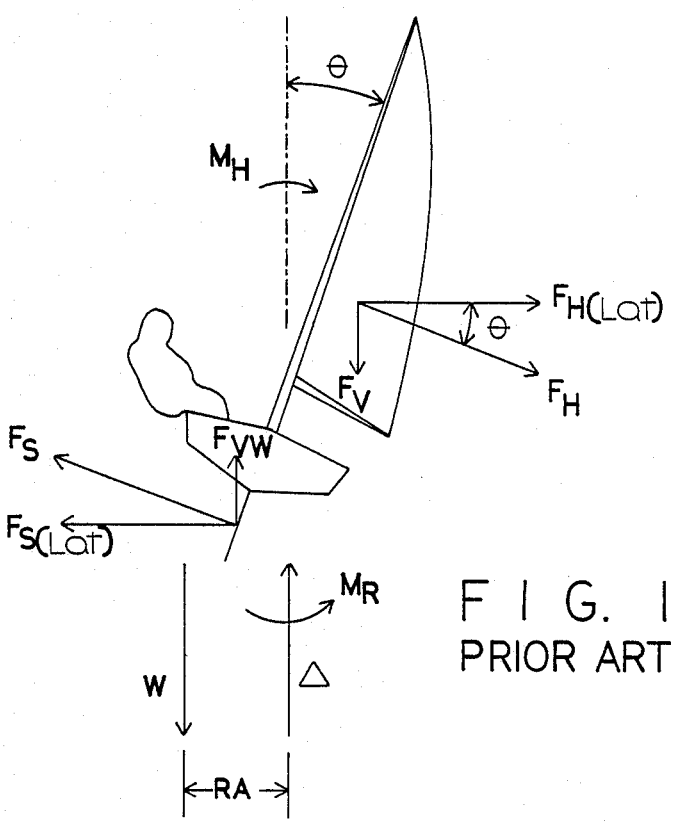
FIG. 1 PRIOR ART
FIG. 1 is a free body schematic diagram of a conventional prior art sailboat taken from a bow, waterline position.

FIG. 1 is a free body schematic diagram of a conventional prior art sailboat taken from a bow, waterline position. The relevant forces acting thereon in a plane that is perpendicular to the hull centerline include $F_H$, which is a side vector resulting from wind force on the sail. This side vector $F_H$ can be resolved into two other vectors, being $F_V$ or the vertical vector and $F_{H(lat)}$ which is the lateral or horizontal side vector. The relationship between $F_H$ and the two vectors into which it is resolved, $F_V$ and $F_{H(lat)}$, is dependent upon the angle $\theta$ which is the angle at which a conventional sailboat leans, or heels, as a consequence of the wind force. The wind force on the sail which causes the heel angle $\theta$, can be considered the heeling moment $M_H$.

This heeling moment, $M_H$ is opposed by a righting moment, $M_R$ which is composed of a resultant righting weight, W, times the righting arm, RA. The righting weight, W, is largely the weight of the sailor shown in silhouette, hiking out over the sailboat, but is also a consequence of other factors, such as the weighted keel of a sailboat so equipped, which is not shown in FIG. 1.

Also shown in FIG. 1 are forces generated on the hull and rudder by the water, specifically the side vector $F_S$ which can also be resolved into components $F_{S(lat)}$ and $F_{VW}$ which refers to the vertical vector. This vertical vector results from the upward force of the water that results in incremental displacement of water as a consequence of the downward vertical vector $F_V$ that results from heeling of the sailboat. Of course, the laws of physics require all of these forces and moments to balance each other in a steady state condition. Accordingly, $F_{VW}$ equals $F_V$, $F_H$ equals $F_S$, $F_{S(lat)}$ equals $F_{H(lat)}$, and $M_H$ equals $M_R$. The negative, or downward $F_V$ that results from heel of the sailboat becomes particularly important for reasons hereinafter outlined.

Figure 2:
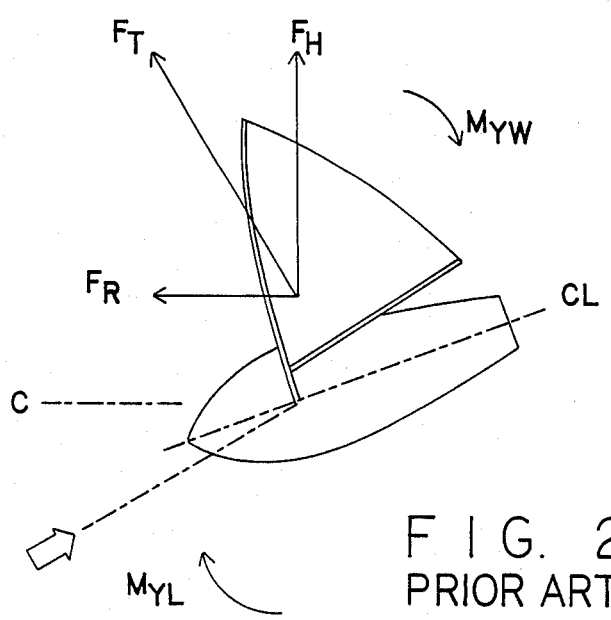
FIG. 2 PRIOR ART
FIG. 2 is a free body schematic diagram of a conventional prior art sailboat taken from overhead.

FIG. 2 is a free body schematic diagram of the same conventional prior art sailboat taken from substantially overhead. The thrust vector $F_T$ resulting from wind pressure on the sail, is shown resolved into $F_H$ the above-described side vector, and $F_R$ which is the drive vector, which moves the sailboat forward. The angle of wind direction is shown by the hollow arrow, and the boat's course C is shown at an angle to the boat's centerline CL because of the leeway which a conventional sailboat makes as a consequence of the side vector $F_H$.

Also shown in FIG. 2 are lee helm yaw moment $M_{YL}$ and its alternative, weather helm yaw moment $M_{YW}$. One or the other of these moments is normally present in a conventional prior art sailboat by reason of the positioning of the center of force of the sails with respect to the center of lateral resistance of the hull taken as a whole. Either results in inefficiency, since they must be overcome by steering the boat to compensate and correct for the moment.

Figure 3:
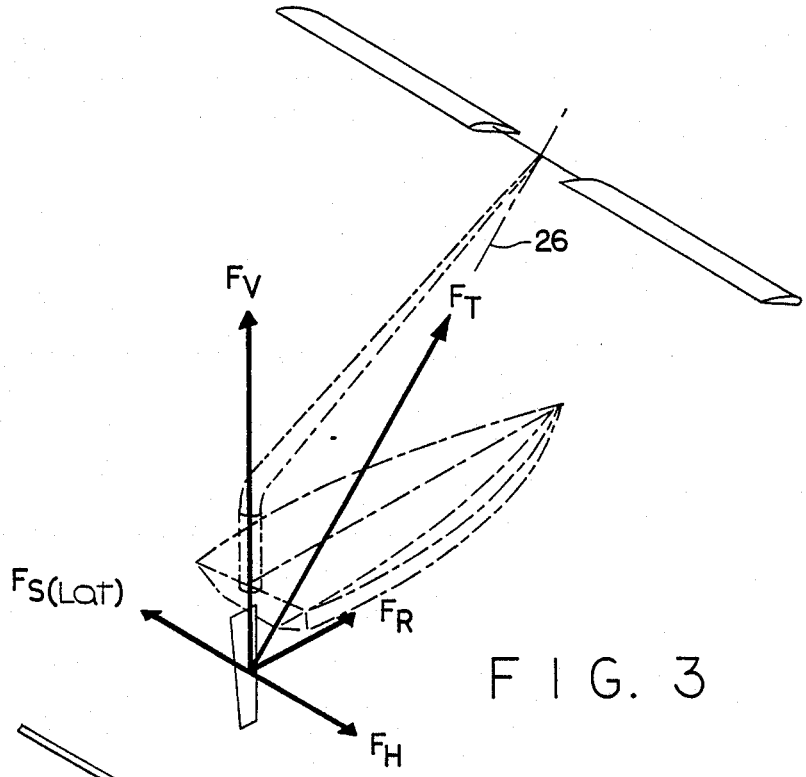
FIG. 3 is a free body schematic perspective diagram of the present invention taken from above the starboard quarter and showing the boat hull and selectively rotatable boom in phantom.

FIG. 3 is a free body schematic perspective diagram of the present invention taken from above. The principal force generating objects, namely an autogyro rotor and rudder are illustrated with the boat hull and selectively rotatable boom being shown in phantom. The rotor creates a thrust vector $F_T$ which always occurs along the rotor axis 26. The selectively rotatable boom, more particularly described hereinafter, is designed so that the rotor axis 26, and the thrust vector $F_T$ always pass through the center of lateral resistance of the rudder and hull taken together. $F_T$ can be resolved into a vertical vector $F_V$, which is upward by reason of the angle of the rotor, and a forward drive vector $F_R$, which is utilized to power the boat. Since the selectively rotatable boom is frequently not in alignment with the centerline of the boat, a side vector $F_H$ is also generated, which is opposed by $F_{S(lat)}$ or the lateral rudder side vector.

Figure 4:
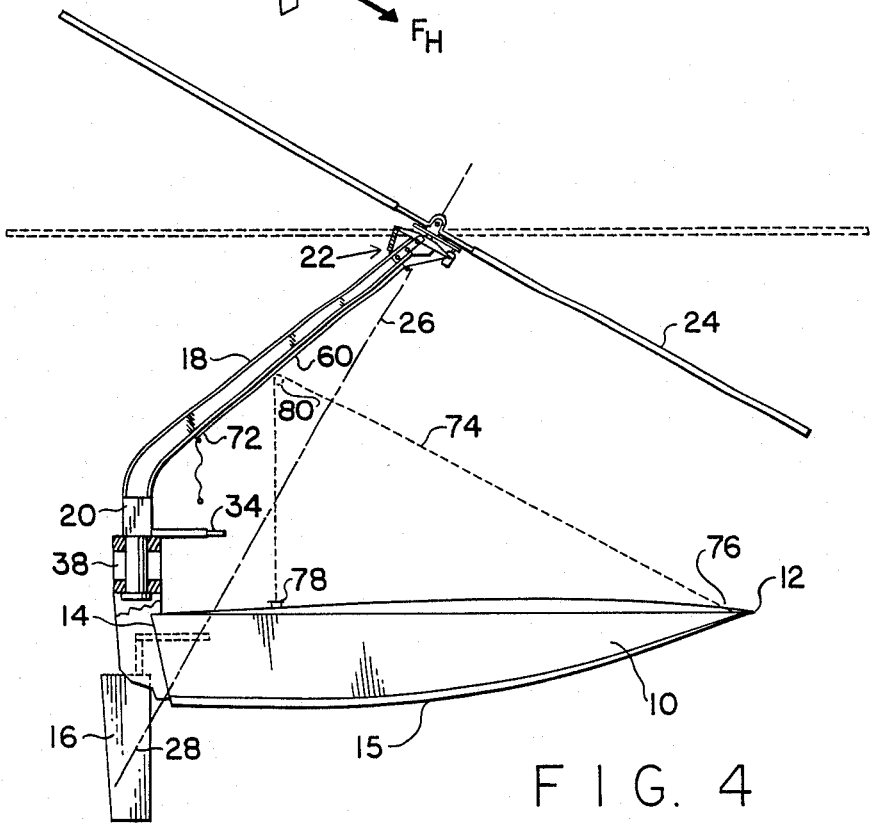
FIG. 4 is a side elevation view of the invention showing the rotational restraint for the boom in a preferred embodiment, with an alternative boom sheet embodiment thereof shown in phantom. The optional "neutral" or horizontal position of the autogyro rotor is also shown in phantom.

FIG. 4 is a side elevation view of the invention showing the rotational restraint for the boom in a preferred embodiment, with an alternative boom sheet embodiment thereof shown in phantom. The "neutral" or horizontal position of the autogyro rotor is also shown in phantom, although this is a much preferred option and not essential to the invention. Specifically, a boat hull 10 is shown with a bow 12, stern 14 and keel 15. It is provided with a rudder 16 mounted on the stern 14. The rudder 16 may include a center of lateral resistance 28 but it is a resultant of lateral resistance of the hull 10 and lateral resistance of the rudder 16 and is merely shown on the rudder 16 as a matter of convenience. Also mounted on stern 14 is a selectively rotatable boom 18 having a rotatable base 20 which is disposed in boom support 38. The boom is preferably supported from the stern, but can be supported from elsewhere in the boat.

At the upper end of boom 18 is supported autogyro 24. It is preferably disposed upon a pivoting rotor mount 22 in which event it can be moved to a canted position or a horizontal position as shown in phantom. If the rotor mount is not of a pivoting design, the autogyro rotor 24 is permanently canted and will preferably be equipped with a means to halt autorotation thereof when that is desired. This means will most likely be a substantial friction brake.

The much preferred embodiment is to utilize a pivoting rotor mount 22 to support the autogyro rotor 24. When the autogyro rotor 24 is canted, its axis 26 passes directly through the center of lateral resistance 28 of rudder 16 and boat hull 10 taken together. The latter is true regardless whether boom 18 is in a vertical plane containing the centerline of the boat, or is positioned at some angle thereto.

The means of rotating boom 18 to a selected position and the maintenance of that position is not critical to the invention and two of the possible alternatives are generally shown in FIG. 4. The preferred embodiment includes a dog actuator 34 which activates a dog and detent array interlocking mechanism shown more fully below. An alternative thereto is a boom sheet 74 shown in phantom, which is in the nature of a jib sheet. Boom sheet 74 has a fixed end 76 and is attached to boom 18 via a boom sheet block 80 and is tied down at boom sheet cleat 78. The invention is also provided with a lanyard cleat 72 to which is tied lanyard 60 that is used to cant autogyro rotor 24, assuming that a pivoting rotor mount 22 is used.

Figure 5:
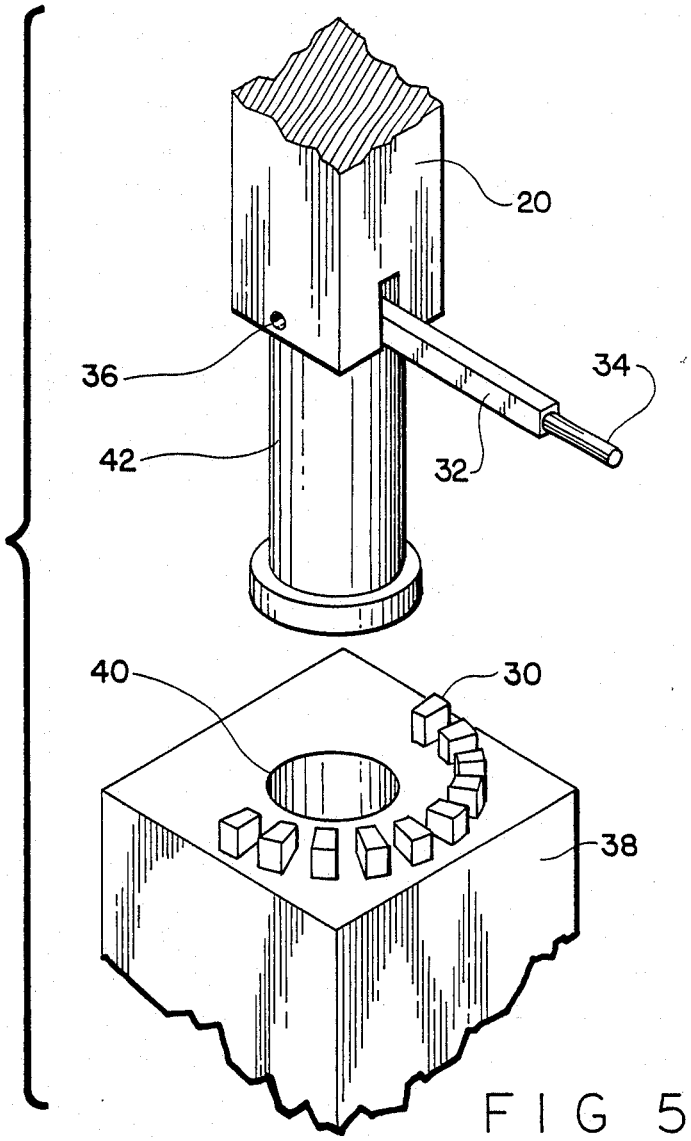
FIG. 5 shows an exploded perspective view of the preferred embodiment of the boom rotational restraint.

FIG. 5 shows an exploded perspective view of the preferred embodiment of the boom rotational restraint. Boom support 38 includes a support bore 40 and a detent array 30. Also shown is rotatable base 20 to which is movably connected dog 32 using dog hinge pin 36. Dog 32 is moved using dog actuator 34 such that when the boom rotational restraint shown in FIG. 5 is assembled, dog 32 interacts with detent array 30 to fix rotatable base 20 in one of a number of discreet locations. Rotatable base 20 is also attached to rotatable base journal 42 which is rotatably positioned within support bore 40 and held in position with collar 44 so that the vertical vector $F_V$ does not cause the rotatable base journal 42 to rise up and become disassembled from the support bore 40.

Figure 6:
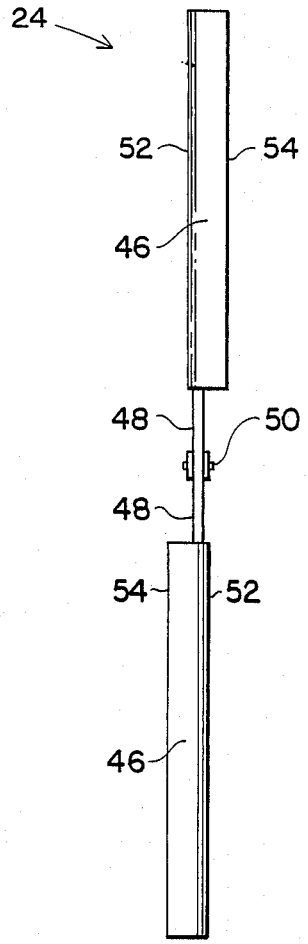
FIG. 6 is a top view of the autogyro rotor.

FIG. 6 is a top view of the autogyro rotor 24, which is comprised of rotor blades 46, rotor blade shafts 48, and is connected to the pivoting rotor mount 22 shown in FIG. 4, utilizing rotor attachment bracket 50. Each rotor blade 46 has a leading edge 52 and a trailing edge 54.

Figure 7:
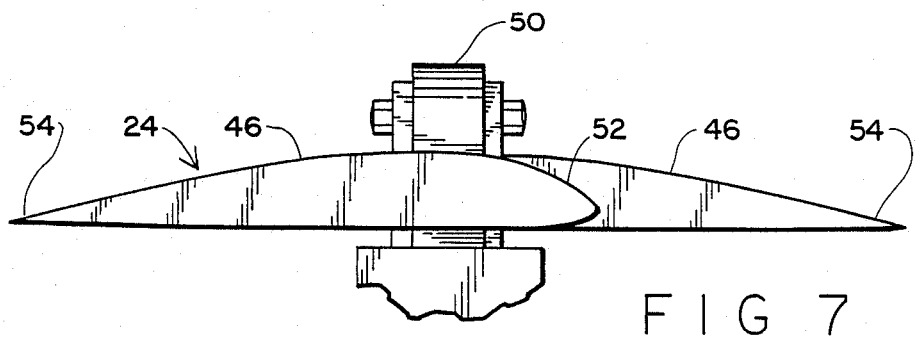
FIG. 7 is an end elevation of the autogyro rotor.

FIG. 7 is an end elevation of the autogyro rotor 24 and illustrates the airfoil shape of the rotor blades 46. The leading edge 52 of a first rotor blade 46 is visible as well as the trailing edges 54 of both rotor blades. Also visible is the rotor attachment bracket 50.

Figure 8:
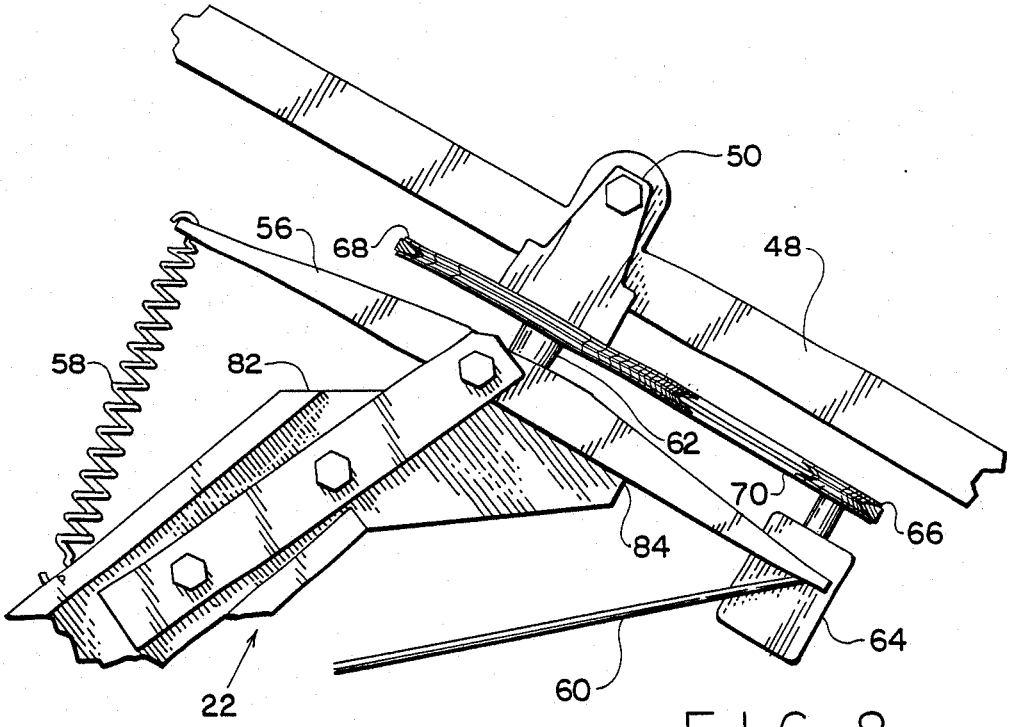
FIG. 8 is a detail side elevation of the pivoting rotor mount at the top of the boom, showing the rotor in its canted position.

FIG. 8 is a detail side elevation of the pivoting rotor mount 22 shown at the top of the boom 18 in FIG. 4. It is comprised of a pivot yoke 56 to one end of which is attached a resilient biasing means 58, and to the other end of which is attached a lanyard 60. In this instance, the lanyard 60 is tensioned, thereby expanding resilient biasing means 58 and positioning pivot yoke 56 against canting stop 84. The rotor blade shaft 48 is thus canted at approximately 30° to the horizontal so that it can rotate on stubshaft 62 in rotor attachment bracket 50.

Optionally, prerotation is obtained through rotator agent 64, preferably an electric motor powered by conventional sources not shown, which is interconnected to stubshaft 64 using a rotator agent pulley 66, a rotor pulley 68, and rotator belt 70. Incidentally, rotator agent 64 can also be used as a braking device by shunting the electrical leads thereto, when the same is necessary to stop the autorotation of autogyro rotor 24, shown in this Figure only with rotor blade shaft 48.

Figure 9:
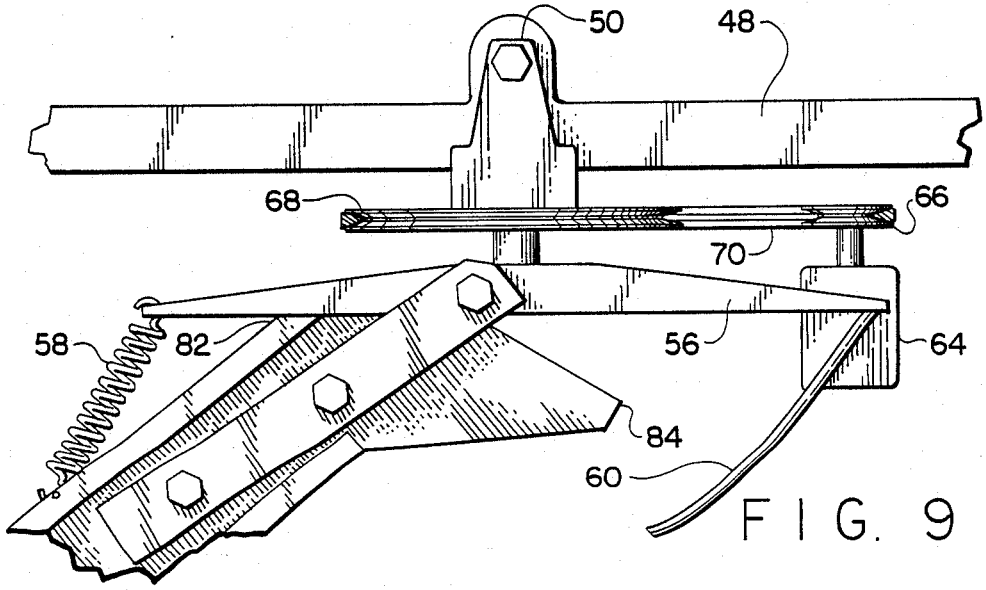
FIG. 9 is a detail side elevation of the pivoting rotor mount in its horizontal position.

Turning finally to FIG. 9, the same apparatus illustrated in FIG. 8 is also shown, except that tension on lanyard 60 is relaxed and pivot yoke 56 is returned to a horizontal position against horizontal stop 82.

In operation, assuming the optional, but strongly preferred, pivoting rotor mount 22 is used, the autogyro rotor is canted using the lanyard so as to harness the wind power. Since the boom and pivoting rotor mount are angled in such a way that the axis of the rotor passes through the center of lateral resistance of the rudder taken together with the boat hull, regardless of the angular orientation of the boom with regard to the boat centerline, heel of the boat and the presence of yaw due to either a weather helm or a lee helm should be eliminated. The absence of heel is important for several reasons.

As described in connection with FIG. 1, heel of the boat produces a downward vector $F_V$. The effect of this downward vector is, of course, to drive the boat hull deeper into the water, which increases both appendage drag, or the amount of water that must be pushed out of the way as the boat moves through the water, and the wetted surface area, which increases frictional drag. Moreover, the greater the degree $\theta$ of heel, the less area of a conventional sail is presented to the wind which blows horizontally over the surface of the water. In the extreme example, a boat which is about to capsize has virtually no surface area exposed to a horizontal wind. Both of these considerations resulting from heel have the effect of reducing the boat's efficiency, and therefore its speed. Moreover, the conventional means to counteract heel include ballast in the keel, which is always present regardless of the degree of heel, and the physically taxing practice of hiking over the gunwale of the boat as illustrated in silhouette in FIG. 1.

In the present invention, however, it will be seen by reference to FIG. 3 that canting of the autogyro rotor 24 produces a thrust $F_T$ which is resolvable into several components which include the driving force $F_R$ and the vertical force $F_V$. Of major importance is the fact that $F_V$ with the present invention is an upward or positive force whereas the vertical force $F_V$ in regard to a conventional sailboat is a downward force. Thus, the present invention not only eliminates the negative $F_V$ of a conventional sailboat, which increases drag as above explained, but actually lifts the boat to some degree out of the water therefore further reducing both appendage and frictional drag. Further, the absence of a heel resulting from the orientation of the thrust through the center of lateral resistance means that ballast can be eliminated, which also further reduces both frictional and appendage drag.

Furthermore, since thrust force is oriented through the center of lateral resistance as above-described, the tendency to either a weather helm or a lee helm, which is present in virtually all conventional sailboats, is eliminated and there results in increase in efficiency and therefore further increase in speed.

The optional ability to cant the autogyro rotor implies the ability to neutralize or deactivate the autogyro rotor when that is desired. In effect, virtually all driving force of the autogyro rotor is eliminated by releasing the lanyard, rendering the orientation of the autogyro rotor to a plane which is essentially identical to the plane of wind direction. Deactivation of the driving force is virtually instantaneous. In addition, the autogyro rotor is equipped with a pre-rotator agent or rotator agent, depending upon whether it is designed respectively for intermittent or continuous use. It is, of course, well established that autorotation of the gyro must be initiated externally, and if the winds are light, autorotation must be supplemented by the rotator agent. Incidentally, the principles of an autogyro copter, and, in particular, the lift that is generated by the wind maintained autorotation of its rotor are well established in the literature and will not be repeated here. Suffice it to say, however, that the principle of an autogyro rotor generates lift which, given the canted position of the autogyro rotor in the present invention, results both in a driving force and a vertical force component creating a positive lift upon the hull. The benefits thereof have already been described.

One further point is that the rotor should be equipped with a braking means if the pivoting rotor mount is not used. Because autorotation of the rotor can reach substantial rpm's in a strong wind, a large friction brake or equivalent is important if the rotor is permanently canted.

While the invention has been described in connection with a preferred embodiment, it will be understood that there is no intention to thereby limit the invention. On the contrary, there is intended to be covered all alternatives, modifications and equivalents as may be included within the spirit and scope of the invention as defined by the appended claims, which are the sole definition of the invention.

What is claimed is:

1. A rotor powered sailboat comprising:

a hull having a centerline and stern;

a stern mounted rudder;

a center of lateral resistance that is a resultant of lateral resistance of the hull and lateral resistance of the rudder;

a boom upwardly angled and selectively rotatable above a support connected to the hull;

a rotor mount attached to an upper end of the boom; and an autogryro rotor rotatably disposed upon the rotor mount, which rotor mount is pivotable with respect to the boom so the rotor can be canted, said rotor having an axis of rotation that passes through the center of lateral resistance when the rotor is canted for any position of the boom with respect to the centerline of the hull.

2. The rotor powered sailboat of claim 1 which further comprises means to secure the boom at any selected angle relative to the centerline.

3. The rotor powered sailboat of claim 2 in which the means to secure the boom comprises:

a boom support fixedly attached to the hull in proximity to its centerline, said boom support containing a support bore substantially vertically disposed therein;

a rotatable base fixedly attached to the boom at its lower end;

a rotatable base journal fixedly attached to and disposed below the rotatable base, said journal sized for rotational movement within the support bore;

a detent array attached to the boom support and located about at least a portion of the periphery of the support bore;

a movable dog attached with a hinge pin to the rotatable base, said dog disposed in a confronting relationship with the detent array for engagement therewith to selectively couple the rotatable base to the boom support at any desired angle of the boom to the centerline; and a dog actuator connected to the dog to move said dog about the hinge pin for engagement with the detent array.

4. The rotor powered sailboat of claim 3 which further comprises a collar attached to a lower end of the rotatable base journal and having an outside diameter greater than a diameter of the support bore to prevent separation of the rotatable base journal and support bore.

5. The rotor powered sailboat of claim 2 in which the means to secure the boom comprises:

a boom support fixedly attached to the hull in proximity to its centerline, said boom containing a support bore substantially vertically disposed therein;

a rotatable base fixedly attached to the boom at its lower end;

a rotatable base journal fixedly attached to and disposed below the rotatable base, said journal sized for rotational movement within the support bore; and a boom sheet connected to both the boom and the hull to limit the angle of boom deviation from the centerline of the hull.

6. The rotor powered sailboat of claim 5 which further comprises a collar attached to a lower end of the rotatable base journal and having an outside diameter greater than a diameter of the support bore to prevent separation of the rotatable base journal and support bore.

7. The rotor powered sailboat of claim 5 in which the means to secure the boom further comprises:

a fixture fixedly connected to the hull to which a fixed end of the boom sheet is attached;

a boom sheet block fixedly connected to the boom through which the boom sheet is passed; and a boom sheet cleat fixedly connected to the hull, to which cleat the boom sheet is removably attachable.

8. The rotor powered sailboat of claim 1 in which the rotor mount comprises:

a horizontal stop at an upper end of the boom and fixedly connected thereto;

a canting stop at the upper end of the boom and fixedly connected thereto;

a pivot yoke pivotally connected to the upper end of the boom and arranged so said yoke can be canted between a position established by the horizontal stop and a position established by the canting stop;

a stubshaft connected to the pivot yoke on which stubshaft the rotor is rotatably supported; and a means to cant the rotor.

9. The rotor powered sailboat of claim 8 in which the means to cant comprises:

a resilient biasing means fixedly connected both to a first end of the pivot yoke and to the boom;

a lanyard cleat fixedly connected to the boom; and a lanyard having a first end fixedly connected to a second end of the pivot yoke, said lanyard having a second end removably attachable to the lanyard cleat.

10. The rotor powered sailboat of claim 8 which further comprises:

a rotor attachment bracket fixedly connected to the rotor and rotatably mounted on the stubshaft;

a rotor pulley fixedly connected to the rotor attachment bracket and adapted for rotation with said bracket;

a rotator agent fixedly connected to the pivot yoke;

a rotator agent pulley fixedly connected to a shaft of the rotator agent and adapted for rotation with said shaft; and a rotator belt interconnecting the rotator agent and rotor attachment bracket.

11. A rotor power assembly adapted for attachment to a boat hull that includes a stern, centerline and stern mounted rudder near a combination of which is located a center of lateral resistance comprising:

a boom upwardly angled and selectively rotatable above a support connectable to the hull;

a rotor mount attached to an upper end of the boom; and an autogyro rotor rotatably disposed upon the rotor mount, which rotor mount is pivotable with respect to the boom so the rotor can be canted, said rotor having an axis of rotation that passes through the center of lateral resistance when the rotor is canted for any position of the boom with respect to the centerline of the hull.

12. The rotor power assembly of claim 11 which further comprises means to secure the boom at any selected angle relative to the centerline.

13. The rotor power assembly of claim 12 in which the means to secure the boom comprises:

a boom support fixedly attached to the hull in proximity to its centerline, said boom support containing a support bore substantially vertically disposed therein;

a rotatable base fixedly attached to the boom at its lower end;

a rotatable base journal fixedly attached to and disposed below the rotatable base, said journal sized for rotational movement within the support bore;

a detent array attached to the boom support and located about at least a portion of the periphery of the support bore;

a movable dog attached with a hinge pin to the rotatable base, said dog disposed in a confronting relationship with the detent array for engagement therewith to selectively couple the rotatable base to the boom support at any desired angle of the boom to the centerline; and a dog actuator connected to the dog to move said dog about the hinge pin for engagement with the detent array.

14. The rotor power assembly of claim 13 which further comprises a collar attached to a lower end of the rotatable base journal and having an outside diameter greater than a diameter of the support bore to prevent separation of the rotatable base journal and support bore.

15. The rotor power assembly of claim 12 in which the means to secure the boom comprises:

a boom support fixedly attached to the hull in proximity to its centerline, said boom suport containing a support bore substantially vertically disposed therein;

a rotatable base fixedly attached to the boom at its lower end;

a rotatable base journal fixedly attached to and disposed below the rotatable base, said journal sized for rotational movement within the support bore; and a boom sheet connected to both the boom and the hull to limit the angle of boom deviation from the centerline of the hull.

16. The rotor power assembly of claim 15 which further comprises a collar attached to a lower end of the rotatable base journal and having an outside diameter greater than a diameter of the support bore to prevent separation of the rotatable base journal and support bore.

17. The rotor power assembly of claim 15 in which the means to secure the boom further comprises:

a fixture fixedly connected to the hull to which a fixed end of the boom sheet is attached;

a boom sheet block fixedly connected to the boom through which the boom sheet is passed; and a boom sheet cleat fixedly connected to the hull, to which cleat the boom sheet is removably attachable.

18. The rotor power assembly of claim 11 in which the rotor mount comprises:

a horizontal stop at an upper end of the boom and fixedly connected thereto;

a canting stop at the upper end of the boom and fixedly connected thereto;

a pivot yoke pivotally connected to the upper end of the boom and arranged so said yoke can be canted between a position established by the horizontal stop and a position established by the canting stop;

a stubshaft connected to the pivot yoke on which stubshaft the rotor is rotatably supported; and a means to cant the rotor.

19. The rotor power assembly of claim 18 in which the means to cant comprises:

a resilient biasing means fixedly connected both to a first end of the pivot yoke and to the boom;

a lanyard cleat fixedly connected to the boom; and a lanyard having a first end fixedly connected to a second end of the pivot yoke, said lanyard having a second end removably attachable to the lanyard cleat.

20. The rotor power assembly of claim 18 which further comprises:

a rotor attachment bracket fixedly connected to the rotor and rotatably mounted on the stubshaft;

a rotor pulley fixedly connected to the rotor attachment bracket and adapted for rotation with said bracket;

a rotator agent fixedly connected to the pivot yoke;

a rotator agent pulley fixedly connected to a shaft of the rotator agent and adapted for rotation with said shaft; and a rotator belt interconnecting the rotator agent and rotor attachment bracket.

21. A rotor, powered sailboat comprising:

a hull having a centerline and a stern;

a stern mounted;

a center of lateral resistance that is a resultant of lateral resistance of the hull and lateral resistance of the rudder;

a boom upwardly angled and selectively rotatable above a support connected to the hull;

a rotor mount that includes a horizontal stop and a canting stop that are both fixedly connected to an upper end of the boom, a pivot yoke pivotably connected to the upper end of the boom and arranged so said yoke can be canted between a position established by the horizontal stop and a position established by the canting stop, and stubshaft connected to the pivot yoke;

an autogyro rotor rotatably disposed upon the stubshaft, having an axis of rotation and subject to being canted such that the axis of rotation passes through the center of lateral resistance; and a means to cant that includes a resilient biasing means fixedly connected both to a first end of the pivot yoke and to the boom, a lanyard cleat fixedly connected to the boom, and a lanyard having a first end fixedly connected to a second end of the pivot yoke, said lanyard having a second end removably attachable to the lanyard cleat.

22. The rotor powered sailboat of claim 21 which further comprises means to secure the boom at any selected angle relative to the centerline.

23. The rotor powered sailboat of claim 22 in which the means to secure the boom comprises:

a boom support fixedly attached to the hull in proximity to its centerline, said boom support containing a support bore substantially vertically disposed therein;

a rotatable base attached to the boom at its lower end;

a rotatable base journal fixedly attached to and disposed below the rotatable base, said journal sized for rotational movement with the support bore;

a detent array attached to the boom support and located about at least a portion of the support bore;

a movable dog attached with a hinge pin to the rotatable base, said dog disposed in a confronting relationship with the detent array for engagement therewith to selectively couple the rotatable base to the boom support at any desired angle of the boom to the centerline; and a dog actuator connected to the dog to move said dog about the hinge pin for engagement with the detent array.

24. The rotor powered sailboat of claim 23 which further comprises a collar attached to a lower end of the rotatable base journal and having an outside diameter greater than a diameter of the support bore to prevent separation of the rotatable base journal and support bore.

25. The rotor powered sailboat of claim 22 in which the means to secure the boom comprises:

a boom support fixedly attached to the hull in proximity to its centerline, said boom support containing a support bore substantially vertically disposed therein;

a rotatable base fixedly attached to the boom at its lower end;

a rotatable base journal fixedly attached to and disposed below the rotatable base, said journal sized for rotational movement within the support bore; and a boom sheet connected to both the boom and the hull to limit the angle of boom deviation from the centerline of the hull.

26. The rotor powered sailboat of claim 25 which further comprises a collar attached to a lower end of the rotatable base journal and having an outside diameter greater than a diameter of the support bore to prevent separation of the rotatable base journal support bore.

27. The rotor powered sailboat of claim 25 in which the means to secure the boom further comprises:

a fixture fixedly connected to the hull to which a fixed end of boom sheet is attached;

a boom sheet block fixedly connected to the boom through which the boom sheet is passed; and a boom sheet cleat fixedly connected to the hull, to which cleat the boom sheet is removably attachable.

28. The rotor powered sailboat of claim 21 which further comprises:

a rotor attachment bracket fixedly connected to the rotor rotatably mounted on the stubshaft;

a rotor pulley fixedly connected to the rotor attachment bracket and adapted for rotation with said bracket;

a rotator agent fixedly connected to the pivot yoke;

a rotator agent pulley fixedly connected to as shaft of the rotator agent and adapted for rotation with said shaft; and a rotator belt interconnecting the rotator agent and rotor attachment bracket.

29. A rotor power assembly adapted for attachment to a boat hull that includes a stern, centerline and stern mounted rudder near a combination of which is located a center of lateral resistance comprising:

a boom upwardly angled and selectively rotatable above a support connectable to the hull;

a rotor mount that includes a horizontal stop and a canting stop that are both fixedly connected to an upper end of the boom, a pivot yoke pivotably connected to the upper end of the boom and arranged so said yoke can be canted between a position established by the canting stop, and a stubshaft connected to the pivot yoke;

an autogyro rotor rotatably disposed upon the stubshaft, having an axis of rotation and subject to being canted such that the axis of rotation passes through the center of lateral resistance; and a means to cant that includes a resilient biasing means fixedly connected both to a first end of the pivot yoke and to the boom, a lanyard cleat fixedly connected to the boom, and a lanyard having a first end fixedly connected to a second end of the pivot yoke, said lanyard having a second end removably attachable to the lanyard cleat.

30. The rotor power assembly of claim 29 which further comprises means to secure the boom at any selected angle relative to the centerline.

31. The rotor power assembly of claim 30 in which the means to secure the boom comprises:

a boom support fixedly attached to the hull in proximity to its centerline, said boom support containing a support bore substantially vertically disposed therein;

a rotatable base fixedly attached to the boom at its lower end;

a rotatable base journal fixedly attached to and disposed below the rotatable base, said journal sized for rotational movement within the support bore;

a detent array attached to the boom support and located about at least a portion of the periphery of the support bore;

a movable dog attached with a hinge pin to the rotatable base, said dog disposed in a confronting relationship with the detent array for engagement therewith to selectively couple the rotatable base to the boom support at any desired angle of the boom to the centerline; and a dog actuator connected to the dog to move said dog about the hinge pin for engagement with the detent array.

32. The rotor power assembly of claim 31 which further comprises a collar attached to a lower end of the rotatable base journal and having an outside diameter greater than a diameter of the support bore to prevent separation of the rotatable base journal and support bore.

33. The rotor power assembly of claim 30 in which the means to secure the boom comprises:

a boom support fixedly attached to the hull in proximity to its centerline, said boom support containing a support bore substantially vertically disposed therein;

a rotatable base fixedly attached to the boom at its lower end;

a rotatable base journal fixedly attached to and disposed below the rotatable base, said journal sized for rotational movement within the support bore; and a boom sheet connected to both the boom and the hull to limit the angle of boom deviation from the centerline of the hull.

34. The rotor power assembly of claim 33 which further comprises a collar attached to a lower end of the rotatable base journal and having an outside diameter greater than a diameter of the support bore to prevent separation of the rotatable base journal support bore.

35. The rotor power assembly of claim 33 in which the means to secure the boom further comprises:

a fixture fixedly connected to the hull to which a fixed end of the boom sheet is attached;

a boom sheet block fixedly connected to the boom through which the boom sheet is passed; and a boom sheet cleat fixedly connected to the hull, to which cleat the boom sheet is removably attachable.

36. The rotor power assembly of claim 29 which further comprises:

a rotor attachment bracket fixedly connected to the rotor and rotatably mounted on the stubshaft;

a rotator pulley fixedly connected to the rotor attachment bracket and adapted for rotation with said bracket;

a rotator agent fixedly connected to the pivot yoke;

a rotator agent pulley fixedly connected to a shaft of the rotator agent and adapted for rotation with said shaft; and a rotator belt interconnecting the rotator agent and rotor attachment bracket.

* * * * *